United States Patent [19]

Komatsubara et al.

[11] Patent Number: 4,754,302

[45] Date of Patent: Jun. 28, 1988

[54] WET TYPE COLOR ELECTROPHOTOGRAPHIC COPYING MACHINE

[76] Inventors: Shoji Komatsubara, 2036-1 Ohyabu-cho; Yasuyuki Oka, c/o Dainippon Screen Mfg. Co., Ltd. 480-1 Takamiya-cho; Toshiaki Danbayashi, c/o Dainipon Screen Mfg. Co., Ltd. 480-1 Takamiya-cho, all of Hikone-shi, Shiga, Japan

[21] Appl. No.: 941,219

[22] Filed: Dec. 12, 1986

[30] Foreign Application Priority Data

Dec. 18, 1985 [JP] Japan ..... 60-285009

[51] Int. Cl.[4] ..... G03G 15/01

[52] U.S. Cl. ..... 355/4; 355/10; 118/660

[58] Field of Search ..... 355/10, 15, 4; 118/659, 118/660

[56] References Cited

U.S. PATENT DOCUMENTS 4,161,361 7/1979 Soma et al. ..... 355/10
4,247,191 1/1981 Grace et al. ..... 355/10 X
4,311,780 1/1982 Mochizuki et al. ..... 355/10 X

FOREIGN PATENT DOCUMENTS 0018332 2/1977 Japan ..... 355/10

*Primary Examiner*—Patrick R. Salce
*Assistant Examiner*—Kristine Peckman
*Attorney, Agent, or Firm*—Lowe, Price, Leblanc, Becker & Shur

[57] ABSTRACT

In a wet type color electrophotographic copying machine, a wet type of developing apparatus and a surplus developer removing device are provided under a photosensitive material carrying device. The developing apparatus comprises a plurality of color developing devices and lifting elements for locating each developing device at the levels of three stages, i.e., a developing position, a blade contacting position and a lowered position. The surplus developer removing device comprises a developer squeezing roller unit, a developer recovery blade both of which are provided at least each color developing device, and an air knife device. The blade is operated to be in contact with a non-image area of the surface, interlockingly with a lowering movement of the developing device from the developing position to the blade contacting position, in order to recover completely the remaining developer through the blade. Color turbidity of a copy image is thus eliminated by enhancement of the surplus developer effect of the removing device.

6 Claims, 4 Drawing Sheets

WET TYPE COLOR ELECTROPHOTOGRAPHIC COPYING MACHINE

BACKGROUND OF THE INVENTION

1. Field of the Invention

The present invention relates to a wet type color electrophotographic copying machine which is provided with a plurality of color developing devices, and in particular, to a wet type color electrophotographic copying machine in which a color turbidity can be eliminated appreciably by the enhancement of a removal effect of a surplus developer removing device thereof.

2. Prior Art

Generally, for such wet type color electrophotographic copying machine, surplus developer removing devices, e.g., as disclosed in Japanese Provisional Patent Publication No. 56 (1981)-21168 are known in the art.

This kind of surplus developer removing device is provided with a developer recovery blade between each color developing device and an air knife device disposed behind that, in order to return some escaped developer to near the blade, A small clearance is also provided between the tip of the developer recovery blade and an image carrying-surface, in order that a toner image on the surface is not put out of order by the tip of the blade. Surplus developer remaining on the image-carrying surface is mostly recovered by the blade. Surplus developer brought out behind the blade with the image-carrying surface is returned to the area near the tip of the blade, by means of air blowing from the air knife device, and is then recovered by the blade.

However, the above-mentioned prior removing device is difficult to set up so as to maintain a uniform clearance between the image-carrying surface and the tip of the blade disposed widthwise thereof. The term "widthwise" is the direction intersecting the direction of the relative movement therebetween. Therefore, the prior art removing device has a problem in that due to the non-uniform clearance between the tip of the blade and the image-carrying surface a stripe-shaped unevenness is generated on the image in the direction of its movement.

It is also known in the art that a developer squeezing roller unit may be used to advantage instead of the developer recovery blade, e.g., as disclosed in Japanese Patent Publication No. 58 (1983)-47707). Such a squeezing roller unit includes at least two contact rollers, disposed so as to be in contact with the image-carrying surface at both ends thereof, and a small diameter roller arranged between the contact rollers so as to have a uniform clearance between the small diameter roller and the image-carrying surface.

However, in known copying machines in which a plurality of developing heads of the color developing devices are constructed so as to be able to approach to and recede from the image-carrying surface, the developer recovery blade or the developer squeezing roller unit set up in each color developing device leaves the image-carrying surface when the color development is completed. Consequently surplus developer held in the above-mentioned clearance still remains at the boundary area of the image-carrying surface where no images exist (hereinafter, referred to a "non-image area"), the remaining developer probably causes a color turbidity in an image developed in the next color developing process.

SUMMARY OF THE INVENTION

The present invention is directed to solving the problems noted above, and has as a principal object the provision of an improvement to a wet type color electrophotographic copying machine, in which color turbidity is eliminated by enhancing removal of surplus developer from an image-carrying surface.

In the present invention, a wet type color electrophotographic copying machine includes a wet type developing apparatus and a surplus developer removing device provided under a photosensitive material carrying device. A toner image is produced on an image-carrying surface, and surplus developer remaining on the image-carrying surface is removed while the surface moves relative to both the developing apparatus and the surplus developer removing device. The developing apparatus includes a plurality of color developing devices and lifting means for locating each color developing device at different levels of three stages, e.g., a developing position, a blade contacting position and a lowered position. The said surplus developer removing device comprises a developer squeezing roller unit, and a developer recovery blade (both of which are provided in each color developing device) and an air knife device. The developer recovery blade is brought into contact with a boundary area of the image-carrying surface from its receded position by interlocking thereof with the lowering movement of the color developing device as the latter moves from its developing position to the blade contacting position. This enables enhanced recovery of surplus developer that may otherwise remain at the boundary area.

Accordingly, surplus developer remaining on the image-carrying surface is removed mostly by the squeezing roller unit during a developing process, and any surplus developer that escapes to the surface behind the roller unit is returned to the area near the roller unit by air blowing from an air knife device so as to be removed via the roller unit.

When the image area of the image-carrying surface passes by the developing heads, the supply of the developer is stopped, the developing heads and the squeezing roller move operatively from the non-image area of the image carrying surface, and the developer recovery blade then moves up to make contact with the non-image area of the surface, in this sequence. Therefore, surplus developer remaining in the clearance between the image-carrying surface and the squeezing roller is removed downwards through the recovery blade.

The foregoing and other objects and attendant advantages of the present invention will be readily appreciated as the same becomes better understood by reference to the following detailed description when considered with the accompanying drawings.

DESCRIPTION OF THE PREFERRED EMBODIMENTS

Figure 1:
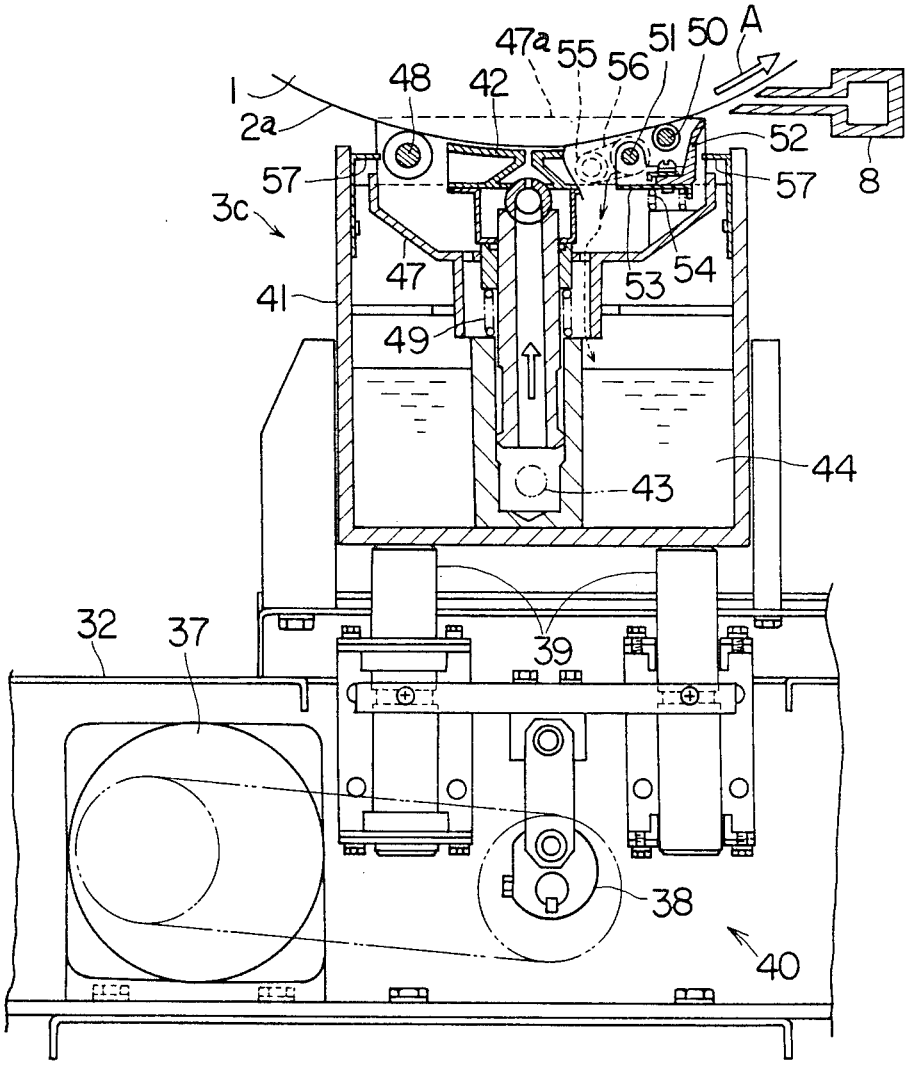
FIG. 1 is a longitudinal sectional view of the principal part of a copying machine including a first embodiment of the color developing device according to this invention.
Figure 2:
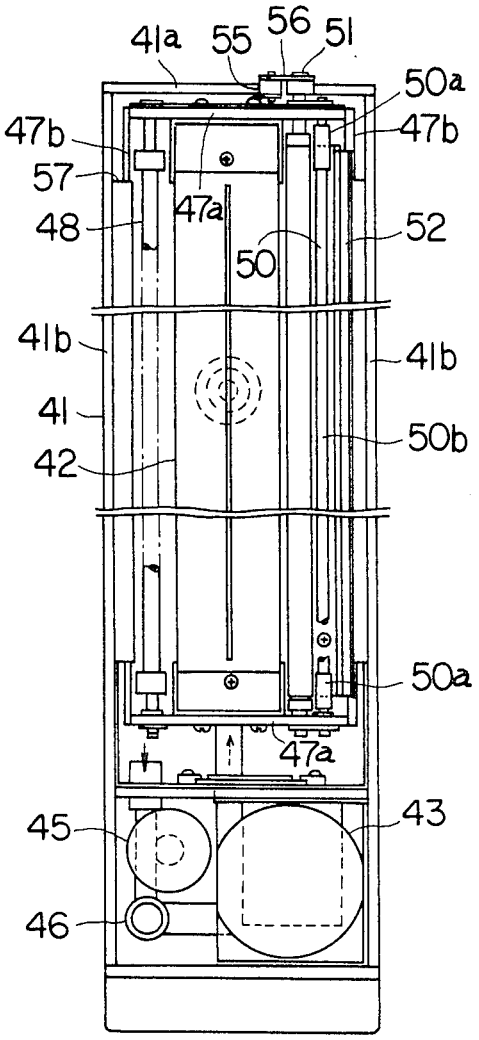
FIG. 2 is a plan view of the color developing device thereof.
Figure 3:
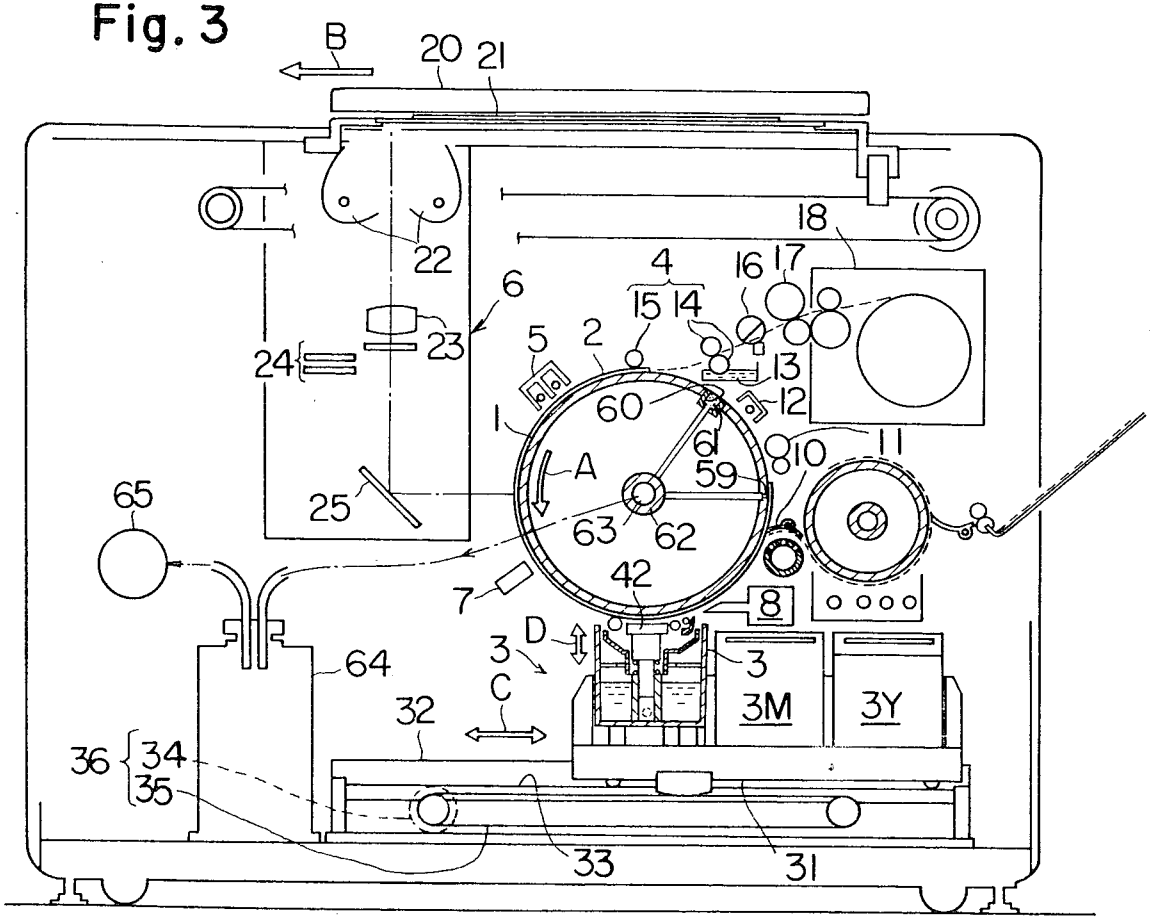
FIG. 3 is a schematic side view of the wet type color electrophotographic copying machine.

Referring to FIGS. 1, 2 and 3, there is shown the first embodiment of the wet type color electrophotographic copying machine according to the present invention, in which a photosensitive material carrying device comprises a drum.

As shown in FIG. 3, the reference symbol 1 is a drum which is adapted to be supported rotatively by the frame of the copying machine and to hold a sheet of photosensitive material 2 on the peripheral surface thereof. Wet type developing apparatus 3 is adapted to develop an electrostatic latent image generated on the photosensitive material 2. Developing apparatus 3 comprises a plurality of color developing devices 3C, 3M, 3Y which are adapted to supply various kinds of color developers as described in detail later.

Around the periphery of the drum 1 and along in the rotational direction A thereof are arranged a photosensitive material winding device 4 for winding the photosensitive material 2 around the drum 1, a charger 5 for applying electrostatic charge to the photosensitive material 2, a focusing optical apparatus 6 for use in producing an electrostatic latent image on the photosensitive material 2 in accordance with an original image, an auxiliary exposing device 7 for use in tone correction, an air knife device 8, a photosensitive material stripping device 10, a drum cleaning device 11 and a de-electrifier 12 disposed face the peripheral surface of the drum 1.

The photosensitive material winding device 4 comprises photosensitive material feed rollers 14 and a press roller 15 for use in pressing down and winding the photosensitive material 2 onto the peripheral surface of the drum 1. A rotary cutter 16, is a photosensitive material supply roller 17, and magazine box 18 for holding a rolled photosensitive material within it are also provided per FIG. 3.

The optical apparatus 6 comprises an illuminating device 22 to illuminate an original 21 held on an original holding frame 20, a focusing lens unit 23, color separating filters 24 and a reflecting mirror 25. While the original 21 is moved in the direction indicated by the arrow B with the holding frame 20, an electrostatic latent image, is produced as a color separated image projected through the focusing lens unit 23 and the color separating filter 24 onto the photosensitive material 2 wound around the drum 1 from slit-like illuminated images of the original 21.

The wet type developing apparatus 3 comprises a cyan developing device 3C, a magenta developing device 3M, a yellow developing device 3Y and a black developing device (not shown in the figures) if desired. By a corresponding color toner it develops the electrostatic latent image, produced on the photosensitive material 2 as a color separated image so as to obtain a color copy image by repeating a color development correspondingly.

As best seen in FIG. 3, each developing device 3C, 3M, 3Y is mounted movably upward and downward (indicated by the arrow D) on a carriage 31 which is provided movably right and left (indicated by the arrow C). That is, the carriage 31 is adapted to be moved and located in position on a pair of guide rails 33 by a driving means 36 composed of a drive motor 34, a chain 35 and other elements. The guide rails 33 are arranged in parallel at opposed sides of a base portion 32 of the machine.

As shown in FIG. 1, in the base portion 32 there is provided a lifting means 40 of the developing device which is composed of a push-up motor 37, a push-up crank mechanism 38 and a pair of push-up rods 39 which support the bottom of the developing device. By the lifting means 40, each of the color developing devices is located respectively at the levels of three stages, i.e., a developing position, a blade contacting position and a lowered position.

Each color developing device, e.g., the cyan developing device 3C (as shown in FIGS. 1 and 2) supports a developing head 42 within a case body 41 thereof. The developing head 42 is adapted to be moved up and down together with the case body 41 and to supply color developer 44 to an image carrying surface 2*a* of the electrophotosensitive material 2 from a feed pump 43. In FIG. 2, the symbol 45 is a bird's fountain type of developer supplementary tank, and 46 is an air vent.

The construction of the present invention is explained hereinbelow.

In FIG. 1, the developing head 42 which is also used as a developing electrode plate, two rollers 48, 50 and a support shaft 51 for the rollers are supported by both forward and rearward side plates 47*a*, 47*a* of a head case 47 thereof. When the color developing device 3C is located at the developing position, the head case 47 is biased through a push-up spring 49 so that two rollers 48, 50 are in contact with drum 1. Therefore, there is formed a clearance between the developing head 42 and the image carrying surface 2*a* of the photosensitive material 2, so that the clearance may be filled with the developer.

As best seen in FIG. 2, behind the developing head 42, there are provided a roller 50, a developer recovery blade 52 and an air knife device 8, in that order along the rotational direction A of the drum 1. The roller 50, is also used as a developer squeezing roller unit and comprises contact rollers 50*a*, 50*a* disposed to be in contact with the image-carrying surface at two ends thereof, and a small diameter roller 50*b* arranged between the both contact rollers 50*a*, 50*a* to form a small squeezing clearance of, for example 0.3–0.4 mm, between roller 50*b* and the image-carrying surface 2*a*. By the small clearance, the toner image is saved from disorder. The developer recovery blade 52 is secured to a swing plate 53 by screws, so as to be supported swingably by the support shaft 51 through the swing plate 53, and is biased upwards by a compression spring 54 from the underside of the swing plate 53.

At the end of the support shaft 51 is secured a swing arm 56 provided with a runner 55 see FIG. 2. The runner 55 is biased to an upper end of a rearward side plate 41*a* of the case body 41 by the spring 54. Therefore, at the developing position where the developing head 42 is held near the drum 1, the developer recovery blade 52 keeps a clearance between its upper edge and the image carrying surface 2*a*.

At the blade contacting position where the case body 41 of the color developing device 3C is lowered a predetermined distance, the upwards movement of the head case 47 is limited to a predetermined level by stopper members 57 secured respectively to the left and right side plates 41*b*, 41*b* of the case body 41 against the push-up spring 49. Also the developing head 42 and the developer squeezing roller unit 50 are kept apart from the image carrying surface 2a of the photosensitive material 2. The runner 55 is pushed down by the spring 54 in accordance with the distance that the case body 41 is lowered relative to the head case 47 so that the blade 52 moves up to be in contact with the peripheral surface of the drum 1. Consequently, surplus developer remaining between the developer squeezing roller unit 50 and the image carrying surface 2a flows down to be removed through the developer recovery blade 52 with the aid of the air pressure from the air knife device 8.

As shown in FIG. 3, the peripheral surface of the drum 1 comprises an image area, on which the sheetlike photosensitive material 2 is wound from the forward of the rotational direction (indicated by arrow A) of the drum, and a non-image area where the photosensitive material does not extend. Along the axial direction of the drum 1 in the forward portion of the image area there are provided a plurality of sucking ports 59 for use in holding the sheetlike photosensitive material 2 in a state of being wound around the drum 1 by section. In the non-image area there is provided a suction groove 60, oriented in the axial direction of the drum 1, which functions to remove surplus developer by suction and in which an absorptive material 61 such as felt or the like is packed in.

The sucking ports 59 and the suction groove 60 are connected respectively to a suction duct 63 provided within the rotary shaft 62 of the drum 1, and the suction duct 63 is connected to a suction blower 65 through a drainer 64.

When suction means 60, as above-mentioned, is provided in the non-image area of the drum 1, the removal of the surplus developer by the blade 52 can be carried out more perfectly.

The operations of the above-mentioned construction of the present invention will now be described in detail.

As best seen with reference to FIG. 1, when the color developing device 3C is located at the developing position, any surplus developer remaining on the rotating image-carrying surface 2a is mostly removed at the position opposed to the developer squeezing roller unit 50 and returned into the case body 41. And after passing by the roller unit 50, the surplus developer that remains on the image carrying surface 2a is pushed back to the area near roller unit 50 by the air blowing from the air knife device 8, and is recovered into the case body 41 by action of the roller unit 50. When the image area of the image carrying surface 2a passes by the developing head 42, the supply of developer is stopped and, at the same time, the color developing device 3C is lowered to the blade contacting position by the lifting means 40. Further, interlockingly with the lowering movement of the device 3C, the developing head 42 and the developer squeezing roller unit 50 are operated to depart away from the drum 1 and the developer recovery blade 52 is operated to be in contact with the non-image area of the image carrying surface 2a. Therefore, any surplus developer remaining between the image carrying surface 2a and the roller unit 50 flows down to be removed by action of the developer recovery blade 52. When the drum 1 further rotates for the above-mentioned suction means 60 to reach the blade 52, any surplus developer still sticking to the blade 52 is sucked away and removed completely. The color developing device 3C is then operated to move down to the lowered position by the lifting means. After that, other color developing devices 3M, 3Y are operated sequentially to carry out the magenta or yellow development in the same manner as the cyan developing device 3C.

Besides the above-mentioned embodiment of the CPC system, wherein the copy image is recorded directly on the photosensitive material 2 wound around the drum 1, the present invention can be applied also to the CPC system wherein a photosensitive lamina is formed integrally onto the peripheral surface.

Figure 4:
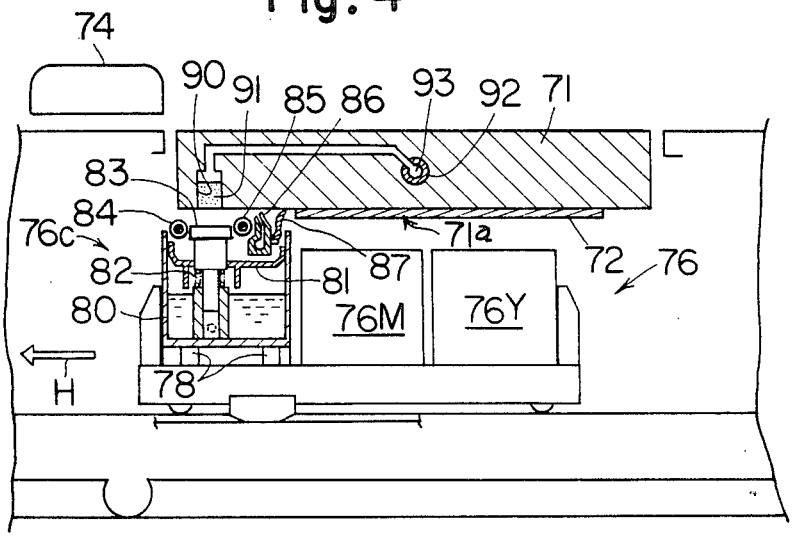
FIG. 4 is a side view of a principal part of the second embodiment at a stage of image development.
Figure 5:
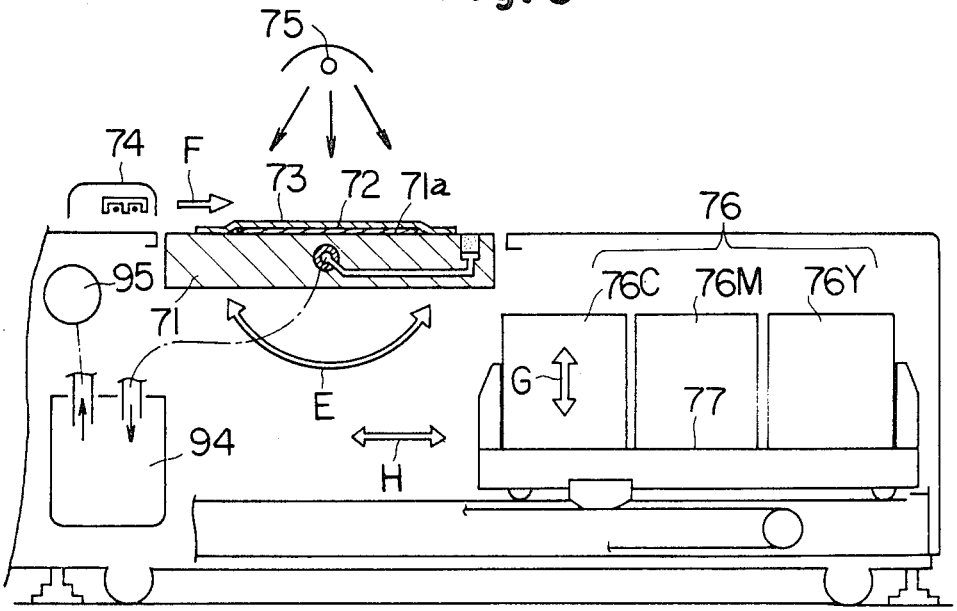
FIG. 5 is a side view of a principal part of the second embodiment at a stage of image exposure.

Referring to FIGS. 4 and 5, there is shown a second embodiment of a wet type color electrophotographic copying machine for color correction to which the present invention is applied, in which a photosensitive material carrying device comprises a flat board type of photosensitive material holder.

First, an outline of such a wet type color electrophotographic copying machine for color correction (hereinafter, referred simply to the corrective copying machine) is now described.

The corrective copying machine is a simple corrective apparatus, which may be utilized in order to check the result of each color separated film negative obtained by a separation of the color original image prior to regular printing by a press. It is constructed so as to be capable of corrective printing as follows.

As shown in FIG. 5, a photosensitive material holding device 71 supported rotatably by the frame (not shown in Figures) is adapted for its holding surface to face upwards by turning it over in the direction of the arrow E. A photoconductive photosensitive material 72 is placed evenly on the holding surface 71a so as to be located by pins and the likes (not shown in the figures) and then to be held by suction.

Then the charger 74 is shifted toward the direction of the arrow F so that electrostatic charge is charged entirely to the photosensitive material 72 thereby. After that, a color separated film negative 73 (for example, a cyan film negative) is placed upon the charged photosensitive material 72, located in place, and held by suction. Then the light source 75 is lit and the image on the negative 73 is exposed onto the photosensitive material 72 so that a electrostatic latent image is produced on the photosensitive material 72.

Further, as shown in FIG. 4, when only the color separated film negative 73 is removed and the photosensitive material 72 is still held by suction as it is, the photosensitive material holding device 71 is turned over in the direction of the arrow E so that the holding surface 71a is face downward, and the color developing device (for example the cyan developing device) 76C corresponding to the negative 73 among the devices of the wet type of developing apparatus 76 is adapted to move upward in the direction of the arrow G. For example, while the developing apparatus 76 is being moved in the direction of the arrow H, the corresponding color developer is supplied to the electrostatic latent image on the photosensitive material 72 so that a visible image is developed by the color toner.

In the same way, each color separated film negative is successively applied to the same photosensitive material 72 by putting marks together, and the exposure and the development are carried out repeatedly so that a corrected print is obtained as a copy of the color original image.

This second embodiment is very different from the first embodiment with respect to constructions such as the photosensitive material holding means which comprises the flat plate-like holding device 71 supported rotatably by the machine frame and, accordingly, the developing process is carried out by the relative movement of both the holding device 71 and the developing apparatus 76 in the horizontal direction H.

Each color developing device 76C, 76M, 76Y is adapted to be operated upward and downward through the case body 80 by the lifting means 78 respectively provided within the carriage 77, and to be located operatively at the levels of three stages, i.e., of the developing position, the intermediate position and the lowered position in the same way as the first embodiment.

Essentially, each color developing device 76C, 76M, 76Y has almost the same construction as that of the first embodiment. That is, the head case 81 is biased upward by the compression spring 82, and on the head case 81 there are provided a developing head 83, two rollers 84, 85, an air knife device 86 and a developer recovery blade 87. Interlockingly with the leaving movement of the developing head 83, two rollers 84, 85 and the air knife device 86 from the image carrying surface, the developer recovery blade 87 is operated to be in contact with the non-image area of the image carrying surface **71*a* so that any surplus developer that remains between the developer squeezing roller 85 and the image carrying surface 71*a* is recovered by action of blade 87. A suction groove 90 is formed in the non-image area in order to suck surplus developer, 91 is an absorptive member, 92 is a pivot shaft, 93 is a suction duct formed in the pivot shaft, 94 is a drainer and 95** is a suction blower, each of which functions the same as corresponding elements in the first embodiment.

As described above, since the wet type color electrophotographic copying machine of the present invention is constructed so that each color developing device is provided with both a developer squeezing roller and a developer recovery blade, and any surplus developer remaining on the image carrying surface is removed by the recovery blade (which is operated to be in contact with the image carrying surface interlockingly with the leaving movement of the squeezing roller when the squeezing roller is operated to leave from the image carrying surface) the partial remains of developer regarded as the problem in the prior art are eliminated and the surplus developer is removed completely from the image carrying surface. Therefore, due to such enhancement of the surplus developer removal action color turbidity of the copied image can be eliminated.

We claim:

1. In a wet type color electrophotographic copying machine, in which a wet type of developing apparatus and a surplus developer removing device are provided under a photosensitive material carrying device, and in which a toner image is produced on an image-carrying surface and any surplus developer remaining on the image-carrying surface is removed while the image-carrying surface is moved relatively to both the wet type developing apparatus and the surplus developer removing device, wet type of developing apparatus comprising:

a plurality of color developing devices and lifting means for selectively locating each color developing device at one of three stages corresponding respectively to a developing position, a blade contacting position and a lowered position, each surplus developer removing device comprising a developer squeezing roller unit, a developer recovery blade and an air knife device, said developer recovery blade being brought into contact with a boundary area of the image-carrying surface where no images exist from a receded position interlockingly with a lowering movement of the color developing device from said developing position to said blade contacting position thereof in order to thereby recover any remaining developer.

2. The wet type color electrophotographic copying machine according to claim 1, wherein:

the color developing device comprises a case body, a head case supported within said case body to be biased upward by a spring and a developing head mounted on said head case, said head case being provided with the developer squeezing roller unit and the developer recovery blade, said developer recovery blade being adapted to be supported swingably through a swing plate by the head case so as to be moved up to said blade contacting position when an arm fixedly secured to an end of a support shaft for the swing plate and engaged to the head case is operated to separate from the case body by a lowering movement of the case body relative to the head case.

3. The wet type color electrophotographic copying machine according to claim 1, wherein:

the photosensitive material carrying device comprises a drum supported rotatably by a frame portion of the copying machine.

4. The wet type color electrophotographic copying machine according to claim 3, wherein:

the photosensitive material carrying device is formed to hold said photoconductive photosensitive material wound around said drum.

5. The wet type color electrophotographic copying machine according to claim 1, wherein:

the photosensitive material carrying device is formed to hold said photoconductive photosensitive material evenly on a flat plate portion thereof.

6. A device for removing surplus developing solution in an electrophotographic color copying apparatus comprising an exposure means for exposing an original image to be copied, a photoconductive receptor in of which a desired latent image is produced, a charger means disposed adjacent to the receptor for applying static electricity as the receptor moves relative to the charger means, and a developing station for supplying a plurality of developing solutions to the receptor as the receptor moves relative to the developing station, to make the latent image visible, wherein said device comprises:

developer supplying means for supplying respective developing solutions to the receptor;

lifting means for lifting said supplying means to enable the same to approach the receptor synchronously with movement of the receptor;

a squeezing roller mounted on said supplying means for squeezing from said receptor surplus developing solution originally supplied from said supplying means, said squeezing roller including end portions having a first diameter and a trunk body having a second diameter smaller than said first diameter, part of the surplus developing solution on an image-holding area of the receptor being removed by the trunk body in such a manner that the trunk body does not make contact with said image-holding area of the receptor;

an air knife disposed adjacent to said squeezing roller for damming up that balance of the surplus developing solution which was not removed by said trunk body;

a blade disposed adjacent to said supplying means, for removing any surplus developing solution present on an area of the receptor not holding an image; and blade actuating means connected with said blade, for actuating the blade from a rest position thereof to make contact with the receptor, said lifting means selectively locating respective supplying means at any of three levels of height, whereof, at a first level the supplying means is located most closely to the receptor and said squeezing roller acts to remove said balance of the surplus developing solution in cooperation with said air knife, at a second level said supplying means is engaged with said link mechanism so as to allow said blade to make contact with the receptor whereby remaining developing solution is completely removed from the receptor, and at a third level said supplying means is located at said rest position thereof.

* * * * *